United States Patent [19]

Gansky et al.

[11] Patent Number: 4,934,264

[45] Date of Patent: Jun. 19, 1990

[54] COLORHEAD PRINTER MOUNTING APPARATUS

[76] Inventors: Alton E. Gansky, 4623 Bella Dr.; William A. Harris, 4490 Emerald Dr., both of Colorado Springs, Colo. 80918

[21] Appl. No.: 376,241

[22] Filed: Jul. 6, 1989

[51] Int. Cl.[5] ..... B41F 5/02; B41F 13/44

[52] U.S. Cl. ..... 101/175; 101/177; 101/247; 101/DIG. 35

[58] Field of Search ..... 101/174, 175, 177, 184, 101/185, 136, 137, 139, 140, 143, 144, 216, 217, 218, 219, 247, 248, DIG. 35, 349, 351

[56] References Cited

U.S. PATENT DOCUMENTS

| | | | |
|---|---|---|---|
| 1,164,212 | 12/1915 | Reifsnyder et al. | 101/216 |
| 2,896,536 | 7/1959 | Sauerman | 101/175 |
| 3,738,265 | 6/1973 | Saueressig | 101/351 |
| 4,111,120 | 9/1978 | Paulson | 101/175 |
| 4,756,245 | 7/1988 | Roch | 101/247 |

*Primary Examiner*—Eugene H. Eickholt
*Attorney, Agent, or Firm*—Phillip A. Rein

[57] ABSTRACT

This invention relates to a colorhead printer mounting apparatus operable to be secured to a printing press and connectable to a colorhead printing assembly usable with the printing press. The colorhead printer mounting apparatus includes a main support jack assembly secured by an anchor bracket assembly to the printing press and having a colorhead support assembly mounted thereon which is operable to support the colorhead printing assembly thereon. The colorhead support assembly includes a mounting bar assembly secured to the colorhead printing assembly and having self-centering means for releasable connection to the colorhead printing assembly operable for raising, lowering, and pivotally moving to a non-use position for repair and maintenance thereon. A second embodiment of this invention utilizes a colorhead trolley support assembly having a mounting bar assembly connected to the colorhead printing assembly and a trolley support arm assembly operable through a trolley actuator assembly in order to move the mounting bar assembly and the interconnected colorhead printing assembly laterally before moving vertically in order to clear various obstacles between the colorhead printing assembly and the printing press. Numerous lock feature structures are provided for holding the colorhead printing assembly in a secure condition when in the usage condition and for securing the colorhead printing assembly to the lift arm assembly of the colorhead support assembly to prevent unintentional damage or dropping of the colorhead printing assembly when moving to the non-usage condition.

18 Claims, 3 Drawing Sheets

COLORHEAD PRINTER MOUNTING APPARATUS

PRIOR ART

A patent search on this invention revealed the following U.S. Pat. Nos.:

Pat. No.

4,222,325
4,365,552
4,554,869
4,572,069

These patents are not deemed pertinent to the applicant's invention claimed herein.

PREFERRED EMBODIMENT OF THE INVENTION

In one preferred embodiment of this invention, a colorhead printer mounting apparatus is used with a printing press and connectable to a colorhead printing assembly to elevate and pivot same to a non-use condition for repair and maintenance on the printing press. The colorhead printer mounting apparatus includes (1) a main support jack assembly positioned adjacent the printing press; (2) an anchor bracket assembly operable to connect the main support jack assembly to the printing press and provide support on an adjacent ground surface; (3) a colorhead support assembly connected to the main support jack assembly; and (4) a press connector assembly operable to releasably connect the colorhead support assembly to the colorhead printing assembly and the printing press. The main support jack assembly includes an inner telescoping member which is operable to raise, pivot and lower the colorhead printing assembly connected thereto. The anchor bracket assembly is provided with a foot support assembly and a side wall connector bracket assembly to secure the main support jack assembly to the printing press and having an adjustment assembly to vertically adjust the main support jack assembly. The colorhead support assembly includes a lift arm assembly which is attachable to the colorhead printing assembly and having a mounting bar assembly mounted thereon. The press connector assembly includes a press connector bracket member secured to the printing press and operable to releasably secure the colorhead printing assembly in the usage condition to the printing press. Another embodiment of the colorhead support assembly is a colorhead trolley support assembly provided with a lift arm assembly and the mounting bar assembly. The colorhead trolley support assembly embodiment has a special design which includes a colorhead and trolley support arm assembly connected to a trolley actuator assembly. The colorhead trolley support assembly is operable to horizontally retract the colorhead printing assembly from the printing press before elevating and pivoting same which is required on certain types of printing presses. The colorhead printer mounting apparatus is provided with a self-centering mounting means to assure accurate, repeat mounting of the colorhead printing assembly on the printing press.

OBJECTS OF THE INVENTION

One object of this invention is to provide a colorhead printer mounting apparatus being easily connected to a printing press and a colorhead printing assembly usable therewith and operable to readily raise and pivot the colorhead printing assembly to a non-use condition for ease of repair and maintenance on the printing press and the colorhead printing assembly.

One further object of this invention is to provide a colorhead printer mounting apparatus which is readily attachable to an existing printing press having a colorhead printing assembly without requiring the use of special skills or tools and readily installed in a minimum amount of time.

Another object of this invention is to provide a colorhead printer mounting apparatus secured to a printing press and its associated colorhead printing assembly and having means for (1) detachment from the printing press; (2) movement of the colorhead printing assembly to a non-use condition; and (3) accurate remounting of the colorhead printing assembly to the printing press with self-centering means for assuring accurate alignment therewith.

One other object of this invention is to provide a colorhead printer mounting apparatus readily attachable to a colorhead printing assembly so as to move the colorhead printing assembly from a usage condition for a printing operation to a non-use condition for storage or maintenance operations achieved in a minimum amount of time without special tools or skills required.

One further object of this invention is to provide a colorhead printer mounting apparatus having a colorhead trolley support assembly connectable to a colorhead printing assembly on a printing press and operable to move the colorhead printing assembly first laterally, second vertically, and then laterally for movement to a non-use condition.

Still, one further object of this invention is to provide a colorhead printer mounting apparatus which is easily installed on a printing press and a colorhead printing assembly used therewith without special tools or drilling of holes; readily operable to move the colorhead printing assembly from a secure print usage condition to a non-use condition to allow repair and maintenance.

Still, another object of this invention is to provide a colorhead printer mounting apparatus used with a printing press which is sturdy in construction; reliable in operation; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
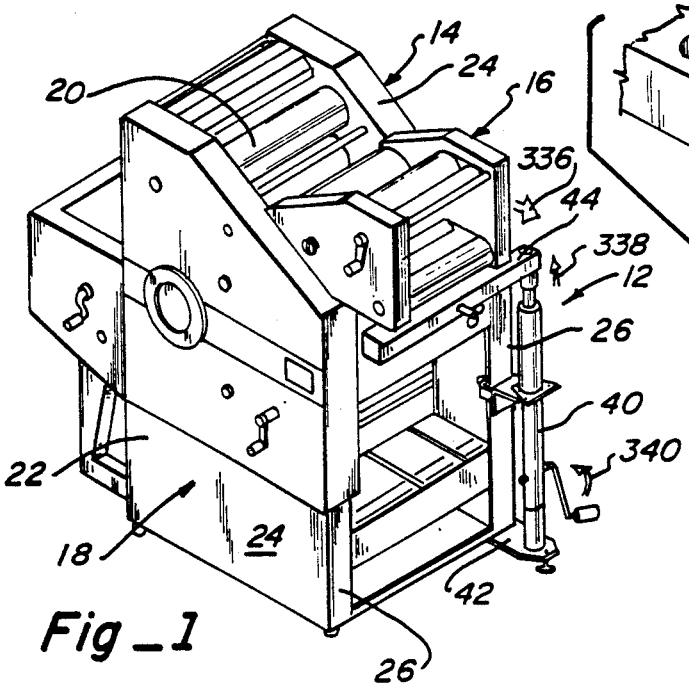
FIG. 1 is a perspective view of a printing press having a colorhead printing assembly connected to a colorhead printer mounting apparatus of this invention.

The following is a discussion and description of preferred specific embodiments of the colorhead printer mounting apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a colorhead printer mounting apparatus of this invention, indicated generally at 12, is used with a printing press 14 having a colorhead printing assembly 16 mounted thereon.

The printing press 14 may be an offset printing press known in the prior art. The printing press 14 includes a main support housing 18 with a duplicator printing assembly 20 connected thereto. The main support housing 18 has a basic support frame 22 and parallel side wall members 24. The parallel side wall members 24 are provided with front support upright leg members 26. The duplicator printing assembly 20 is provided with print roller members 28 and a paper feed assembly 30 and operable in a conventional manner.

The colorhead printing assembly 16 is operable to achieve single or double color printing jobs but requires that the colorhead printing assembly 20 be removed for subsequent use and ease of operation of the printing press 14. The colorhead printing assembly 16 includes a printer support frame 32 and a colorhead print assembly 34 mounted therein. The printer support frame 32 is provided with spaced parallel support walls 36. The colorhead print assembly 34 is provided with printing color roller members 38 operable in a conventional manner.

Figure 2:
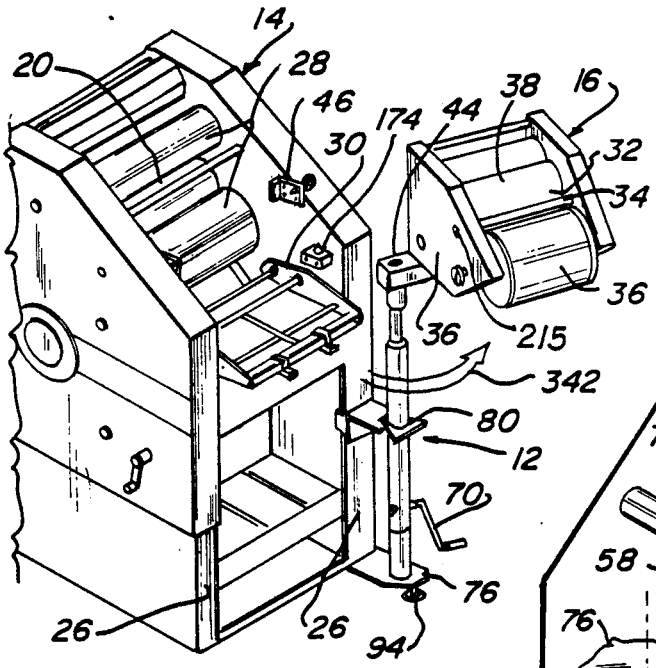
FIG. 2 is a fragmentary perspective view as shown in FIG. 1 illustrating the use of the colorhead printer mounting apparatus of this invention having the colorhead printing assembly connected thereto moved to the non-use condition.

The main problem to be solved by the colorhead printer mounting apparatus 12 of this invention is detachment of the colorhead printing assembly 16 from the printing press 14 and moving same with a minimum amount of effort from the usage printing condition of FIG. 1 to the non-printing or non-use condition of FIG. 2 for repair and/or maintenance. The prior art practice has been to detach the colorhead printing assembly 16 from the printing press 14 which requires two operators to grasp and remove same. Then, the colorhead printing assembly 16 is normally placed on a workbench or the like while repair, cleaning, and maintenance is achieved on both the printing press 14 and the colorhead printing assembly 16. This is an undesirable operation in removing, lifting, and replacing the colorhead printing assembly 16 due to its weight and damage can result to the colorhead printing assembly 16 while being placed on a workbench. The colorhead printer mounting apparatus 12 of this invention is operable to overcome these problems on connecting, moving, and elevating the colorhead printing assembly 16 from the printing press 14 to an adjacent non-use condition.

The colorhead printer mounting apparatus 12 includes (1) a main support jack assembly 40 connected to the printing press 14 and adjustably supported on an adjacent ground surface; (2) an anchor bracket assembly 42 operable to connect the main support jack assembly 40 to the printing press 14; (3) a colorhead support assembly 44 mounted on the main support jack assembly 40 and connectable to the colorhead printing assembly 16; and (4) a press connector assembly 46 connected to the printing press 14 and releasably connected to the colorhead printing assembly 16.

Figure 3:
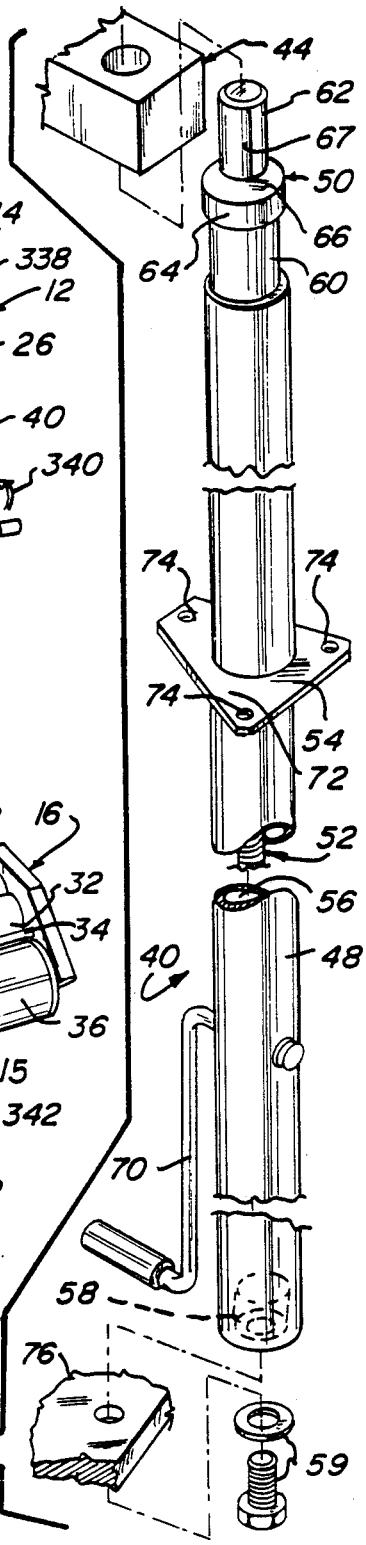
FIG. 3 is a fragmentary exploded perspective view of a main support jack assembly of the colorhead printer mounting apparatus of this invention.

As best shown in FIG. 3, the main support jack assembly 40 includes (1) an outer support cylinder 48; (2) an inner telescoping tube member 50 mounted within the outer support cylinder 48; (3) a gear mechanism assembly or actuator means 52 connected to and mounted within the outer support assembly 48; and (4) an intermediate support bracket 54 to be connected through the anchor bracket assembly 42 to the printing press 14.

The outer support cylinder 48 has a central opening 56 to receive the inner telescoping tube member 50 therein; an anchor threaded hole 58 in a lower end thereof; and an anchor bolt member 59 operable to connect the outer support cylinder 48 to the anchor bracket assembly 42 in a manner to be explained.

The inner telescoping tube member 50 includes a movable cylinder member 60 and a connector head assembly 62 secured to an upper end of the movable cylinder member 60. The connector head assembly 62 includes a support collar member 64 having a support surface 66 and integral with an upright connector shaft 67. The support surface 66 and connector shaft 67 cooperate to receive and support the colorhead support assembly 44 thereon.

The gear mechanism assembly 52 includes a conventionally known rack and pinion assembly as mounted within the outer support cylinder 48 and operable through rotation of an actuator handle member 70. The use of the rack and pinion assembly to telescopingly move the tube member 50 within the outer support cylinder 48 is well known in the art. The direction of vertical movement of the telescoping tube member 50 depends on the direction of rotation of the actuator handle member 70.

The intermediate support bracket 54 includes a support plate member 72 having a plurality of connector holes 74 for attachment to the printing press 14 as will be explained.

Figures 4, 5, 6, 7:
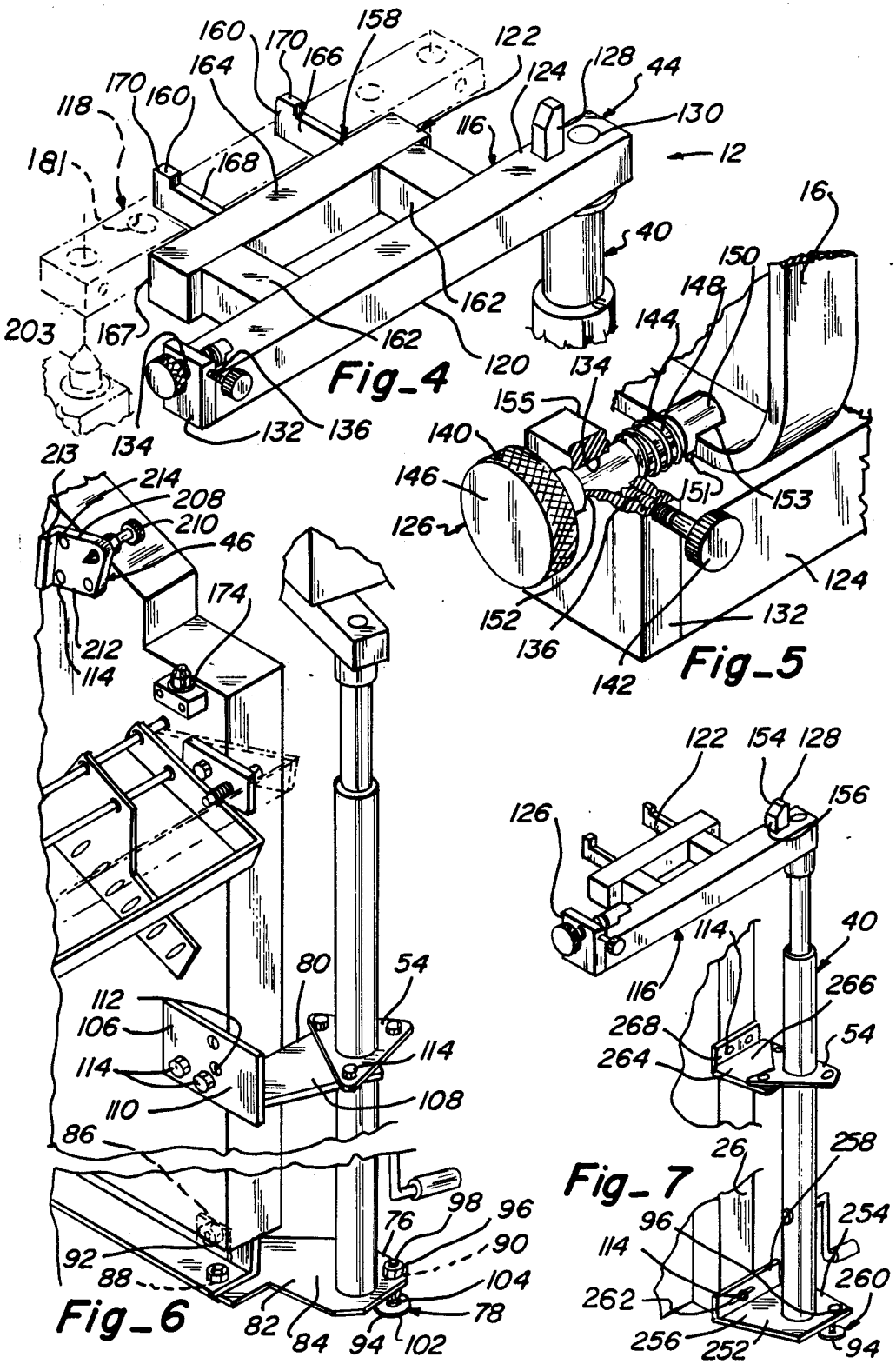
FIG. 4 is a perspective view of one embodiment of a colorhead support assembly of the colorhead printer mounting apparatus of this invention.
FIG. 5 is a fragmentary perspective view illustrating a colorhead latch assembly for connection to the colorhead printing assembly when using the colorhead printer mounting apparatus of this invention.
FIG. 6 is a fragmentary perspective view illustrating the main support jack assembly connected to the printing press shown in the non-use condition.
FIG. 7 is a perspective view of a colorhead printer mounting apparatus of this invention illustrated in the usage condition without a colorhead printing assembly mounted thereon.

As noted in FIG. 6, the anchor bracket assembly 42 includes (1) a foot support assembly 76 mounted on a lower end of the main support jack assembly 40; (2) a connector assembly 78 to secure the foot support assembly 76 to the printing press 14; and (3) a side wall connector bracket assembly 80 operable to connect the intermediate support bracket 54 to the printing press 14.

The foot support bracket 76 includes a bracket plate member 82 of irregular shape having a main body section 84 integral with an upright connector lug 86. The main body section 84 is provided with a plurality of anchor holes 88 and an adjustment hole 90.

The connector assembly 78 includes a plurality of nut and bolt members 92 operable to connect the bracket plate member 82 to an adjacent portion of a front support leg member 26 of the main support housing 18 of the printing press 14 and having an adjustment assembly 94.

The adjustment assembly 94 includes a pair of anchor nuts 96 connectable to a support bolt member 98 to anchor same in a desired adjusted position. More particularly, the bolt member 98 includes a support head 102 to be supported on an adjacent support surface and a threaded shaft section 104 having the anchor nuts 96 mounted thereon to achieve a vertical locked adjustment of the support bolt member 98.

The side wall connector bracket assembly 80 includes an L-shaped bracket member 106. The L-shaped bracket member 106 includes a support section 108 integral with a connector section 110, a plurality of connector holes 112, and nut and bolt members 114 to attach the bracket member 106 to a side wall member 24 of the printing press 14. Also, the nut and bolt members 114 are operable to attach the support section 108 to the intermediate support bracket 54 of the main support jack assembly 40 as noted in FIG. 6.

As noted in FIG. 4, one embodiment of the colorhead support assembly 44 includes (1) a lift arm assembly 116 which is releasably and pivotally connected to the main support jack assembly 40; and (2) a mounting bar assembly 118 which is connected to the colorhead printing assembly 16. The lift arm assembly 116 includes a main support bar assembly 120 having a colorhead support arm assembly 122 connected thereto.

The main support bar assembly 120 includes (1) a main tube member 124; (2) a colorhead latch assembly 126 connected to the tube member 124; and (3) a side plate member 128 mounted on an upper surface of the tube member 124.

The tube member 124 has a connector hole 130 to receive the connector shaft 67 of the main support jack assembly 40 and a clamp support member 132 secured to one end of the tube member 124 having a clamp support hole 134 and an anchor support hole 136 therein.

As noted in FIG. 5, the colorhead latch assembly 126 includes (1) a clamp member 140 mounted within the clamp support hole 134; (2) an anchor screw 142 mounted within the anchor support hole 136; and (3) a bias member 144 mounted about the clamp member 140 to urge same into a clamped position.

The clamp member 140 includes a head section 146 integral with a shaft section 148 which, in turn, is integral with a connector section 150. The shaft section 148 has an anchor opening 152 which is engagable with the anchor screw 142 to hold in a locked position. The connector section 150 is provided with an anchor portion 153 which is of a half moon shape to contact and hold a portion of the colorhead printing assembly 16 in a clamped relationship against the tube member 124.

The bias member 144 engages a stop lug member 151 on the connector section 150 and contacts an inside surface 155 of the clamp support member 132 so as to bias the entire colorhead latch assembly 126 to the position as shown in FIG. 5.

The side plate member 128 is adjustably mounted on the tube member 124 and is provided with a tapered section 154 integral with a contact wall section 156. The purpose of the side plate member 128 is so that it can be usable in conjunction with the colorhead latch assembly 126 to contact and hold the colorhead printing assembly 16 thereon to prevent undesirable lateral movement. Also, this adjustment feature is necessary in order to return the colorhead printing assembly 16 to its original print usage condition repeatedly as noted in FIG. 1 which is an important feature of this invention.

The colorhead support assembly 122 includes a support frame assembly 158 secured to the tube member 124 and having anchor support lugs 160 connected thereto. The support frame assembly 158 includes parallel support leg sections 162 having a transverse support bar 164 secured to outer spaced ends of the parallel support leg sections 162.

The anchor support lugs 160 are provided with L-shaped body sections 166. The L-shaped body sections 166 are provided with an outer upright connector section 170 cooperating with an outer upright surface 167 of the support bar 164 to receive and abut the mounting bar assembly 118 to prevent lateral movement in downward, forward, and rearward directions.

Figure 9:
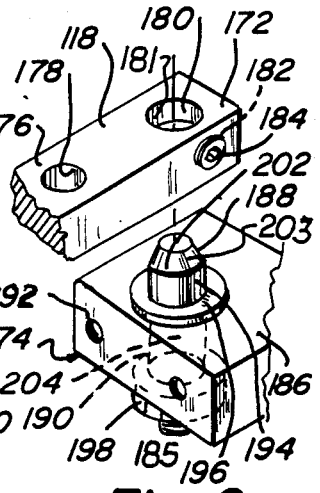
FIG. 9 is a fragmentary perspective view illustrating a mounting cone assembly of a mounting bar assembly of the colorhead printer mounting apparatus of this invention.

As shown in FIG. 9, the mounting bar assembly 118 includes a mounting bar 172 being of rectangular shape in transverse cross section and a mounting cone assembly 174. The mounting bar member 172 includes (1) a main bar body 176 having spaced connector openings 178 adapted to receive a bolt member for attachment to the colorhead printing assembly 16; (2) a conical support opening or first self-centering means 180 at each end of the main bar body 176 to receive the mounting cone assembly 174 therein; and (3) set screw openings 182 positioned in cooperation with and adjacent to respective ones of the conical support openings 180. The set screw openings 182 are threaded to receive set screw members 184 therein which transverse the conical support openings 180 and are engageable with a portion of the mounting cone assembly 174 as will be noted.

The mounting bar 172 is operable to be secured as by bolt members permanently and rigidly to the colorhead printing assembly 16 which is engageable with the colorhead support arm assembly 122 and the tube member 124 for receiving and supporting the colorhead printing assembly 16 thereon.

The mounting cone assembly 174 includes a pair of support cone assemblies or second self-centering means 174, 185, one mounted on each inner surface of the front side walls 24 of the main support housing 18 of the printing press 14. Each support cone assembly 185 includes an existing support bracket member 186 and a cone assembly 188 connected thereto. The support bracket members 186 each include a cone opening 190 and connector holes 192. The cone opening 190 is to receive the cone assembly 188 therein. The connector holes 192 are threaded to receive set screw members 184 for attaching to the respective side wall member 24 of the printing press 14.

As noted in FIG. 9, each cone assembly 188 includes a cone member 194 having an integral stepped section 196 and secured to a respective support bracket member 186 by a nut member 198.

The cone member 194 is provided with (1) a support head section 202; and (2) a threaded body section 204 to receive the nut member 198 thereon.

Each support head section 202 is provided with a conical surface 203 which cooperates with a respective conical support surface 181 in the mounting bar member 172 as noted in dotted lines in FIG. 4 when in the interconnected condition. This achieves a self-centering means function of this invention.

The press connector assembly 46 includes existing press connector brackets 208 mounted on opposite facing sides of the side wall members 24 of the printing press 14 and anchor bolt members 210 secure the press connector bracket members 208 to subject side wall members 24. Each press connector bracket member 208 includes a main body section 214 integral with a stop lug member 213. Each main body section 212 is provided with anchor holes 24 which are secured as by nut and bolt members 114 to the respective side wall members 24 of the printing press 14.

The stop lug members 213 are operable to engage the colorhead printing assembly 16 to limit movement in a horizontal direction when mounted in the printing press 14.

The anchor bolt members 210 may be selectively placed within a hole 215 in respective support wall members 36 of the colorhead printing assembly 16 when in the print usage condition.

It is recognized that the colorhead printer mounting apparatus 12 of this invention can be attached to various models of printing presses 14 which requires that other embodiments of connecting means are necessary in attaching thereto. Another embodiment is noted in FIG. 8 wherein a foot support assembly 216 is used having a bracket plate member 218 secured by a connector assembly 220 to the printing press 14. The bracket plate member 218 includes a main body portion 222 having an integral upright connector lug 224. The main body portion 222 is provided with anchor holes 226 and an adjustment hole 228.

The connector assembly 220 includes bolt members 230 for attachment to the printing press 14. An adjustment assembly 94 with an anchor nut 96 having a support bolt member 98 is mounted within the adjustment hole 228 for adjustment movement thereof and contact with an adjacent support surface for vertical adjustment purposes.

Figure 8:
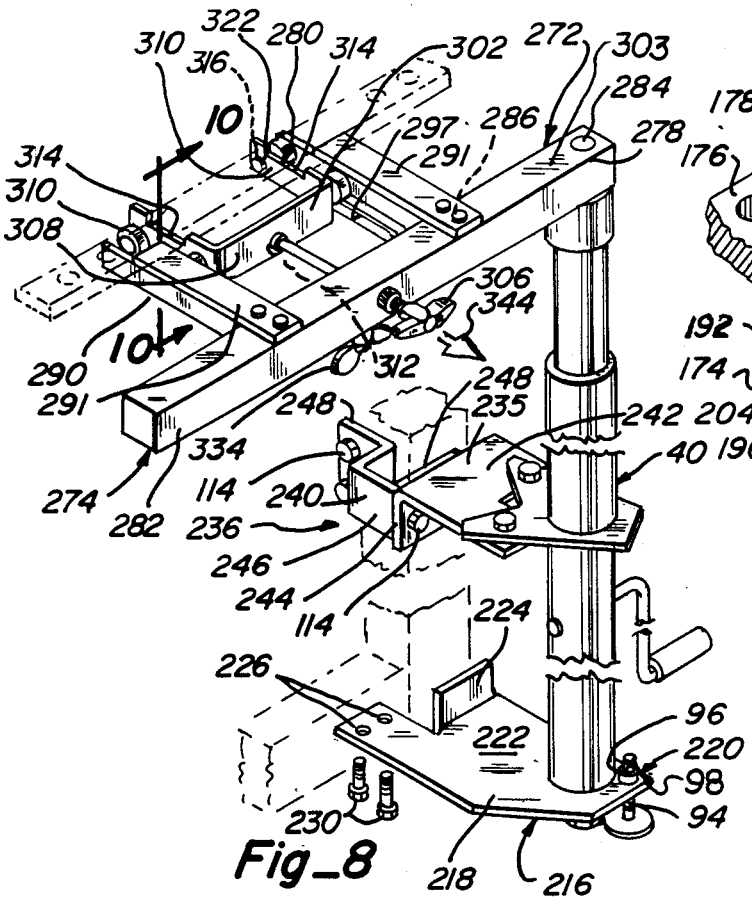
FIG. 8 is a fragmentary perspective view of the colorhead printer mounting apparatus of this invention illustrating a second embodiment having a colorhead trolley support assembly for attachment to and movement of a colorhead printing assembly.

In conjunction with the foot support assembly 216 of FIG. 8, a side wall connector bracket assembly 236 is provided with an L-shaped bracket member 238 and a connector bracket member 240 of irregular shape. The bracket member 238 is provided with a main body portion 242 having a connector lug 244 integral therewith. A plurality of nut and bolt members 114 are used for attachment to the printing press 14.

The connector bracket member 240 has a main body section 246 with integral connector lug sections 248. Each connector lug section 248 is provided with connector holes 250 which are attachable by nut and bolt members 114 to the printing press 14.

Another embodiment of the connector means for attachment to various types of printing presses 14 is noted in FIG. 7. A foot support assembly 252 includes an L-shaped bracket plate member 254 having a main body portion 256 integral with an upright connector lug 258, all which are attached to the printing press 14 through a connector assembly 260. The main body portion 256 has anchor holes 262 and an adjustment hole.

The connector assembly 260 includes nut and bolt members 114 for attachment to the printing press 14 and an adjustment assembly 94 secured through an anchor nut 96 to the main body portion 256 operable for adjustable movement of the main support jack assembly 40.

The embodiment of FIG. 7 further includes a side wall connector bracket assembly 264 having an L-shaped bracket member 266 integral with a connector lug 268. The connector lug 268 is secured as by the nut and bolt members 114 to the printing press 14.

In an embodiment of the colorhead printer mounting apparatus 12 of this invention, a colorhead trolley support assembly 272 is operable to replace the colorhead support assembly 44 of the first embodiment and functions to move an attached colorhead printing assembly 16 laterally before moving vertically to the non-use condition and visa-versa when moving the colorhead printing assembly 16 to the print usage condition engaged with the printing press 14.

Figure 10:
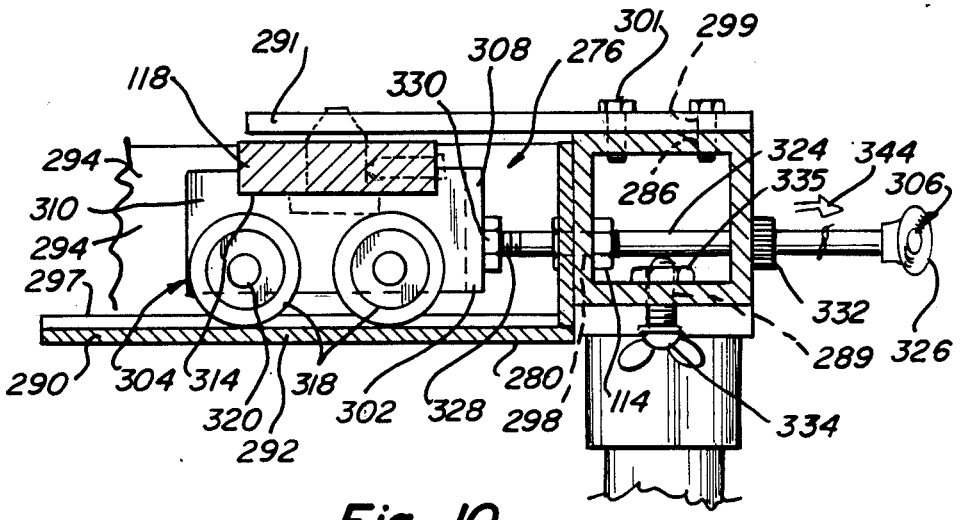
FIG. 10 is an enlarged fragmentary sectional view taken along line 10—10 in FIG. 8.

As noted in FIGS. 8 and 10, collectively, the colorhead trolley support assembly 272 includes a lift arm assembly 274 having a trolley actuator assembly 276 connected thereto and operable in conjunction with the mounting bar assembly 118. The lift arm assembly 274 includes a main support bar assembly 278 having a trolley support arm assembly 280 connected thereto.

The main support bar assembly 280 includes (1) a support tube 282 having a support hole 284 at one end thereof to receive therein the connector shaft 67 of the inner telescoping tube member 50 of the main support jack assembly 40; (2) support anchor holes 286 for connection to the trolley actuator assembly 276; (3) a handle support hole 288; and (4) a lock anchor hole 289 in a bottom surface of the support tube member 282.

The trolley support arm assembly 280 is provided with a pair of parallel support angle iron members 290 of L-shape in transverse cross section and retainer plate members 291 secured to an upper surface of the support tube member 282.

Each support angle iron member 290 is provided with a wheel support section 292 integral with upright wall sections 294 and an outer connector end wall section 296.

The wheel support sections 292 are each provided with a wheel retainer ridge 297 extended longitudinally thereof for cooperation with the trolley actuator assembly 276 as will be explained.

The connector end wall sections 296 are each provided with connector holes 298 for receiving nut and bolt member 114 therein for securing to the support tube member 282.

The retainer plate members 291 are rectangular sheet metal having connector holes 299 therein for attachment through bolt members 301 mounted in threaded openings in a top wall 303 of the support tube member 282.

The trolley actuator assembly 276 includes (1) a mounting bar support frame 302 of generally U-shape; (2) a trolley wheel support assembly 304 mounted on the mounting bar support frame 302; and (3) an actuator handle assembly 306 mounted in the support tube member 282 and connected to the mounting bar support frame 302 for movement thereof.

The mounting bar support frame 302 is provided with a central support section 308 integral at outer ends with respective parallel leg support sections 310. The central support section 308 is provided with a central handle connector hole 312 to receive the actuator handle assembly 306 therein as will be noted.

Each leg support section 310 is provided with an upper notched bar support section 314 to receive the mounting bar assembly 118 therein and wheel support holes 316. The bar support sections 314 cooperate to support the mounting bar assembly 118 and prevent lateral movement in downward, forward, and rearward directions.

The trolley wheel support assembly 304 includes a plurality, namely four, wheel members 318, each attached to a support shaft 320 mounted through respective ones of the wheel support holes 316 and secured thereto as by bolt members 322.

The wheel members 318 each have a central groove therein about its outer periphery so as to ride about the wheel retainer ridge 297 of the respective support angle iron members 290 to prevent lateral movement of the trolley actuator assembly 276.

The actuator handle assembly 306 is of T-shape having (1) a main handle shaft 324; (2) a handle member 326 mounted on an outer end of the main handle shaft 324; (3) an inner threaded end section 328 of the main handle shaft 324; (4) anchor nut members 330 operable to connect the threaded end section 228 to the central support section 308 of the mounting bar support frame 302; (5) a collar member 332 mounted about the main handle shaft 324 and the handle connection hole 312 of the central support section 308; (6) a lock screw member 334 mounted within the lock anchor hole 289 in the support tube member 282; and (7) a lock nut member 335 on th threaded inner end of the lock screw member 334.

The lock screw member 334 is adjustably movable and engagable with the adjacent portion of the main handle shaft 324 to hold in an adjusted position of the moving bar support frame 302 on the support angle iron member 290.

USE AND OPERATION OF THE INVENTION

In the use and operation of the colorhead printer mounting apparatus 12 of this invention as noted in FIGS. 1 and 2, the colorhead printing assembly 16 is releasably mounted relative to the printing press 14 by the colorhead printer mounting apparatus 12. In the prior art, a plurality of latches and nut and bolt members are released and/or removed to transfer the colorhead printing assembly 16 from the printing press 14 requiring manual labor and two operators to achieve this function.

In the use of the colorhead printer mounting apparatus 12, the main support jack assembly 40 is secured in an upright position adjacent to front support leg members 26 of the printing press 14 and secured through the anchor bracket assembly 42. More specifically, the anchor bracket assembly 42 includes a foot support assembly 76 and a side wall connector bracket assembly 80 which are secured by the connector assembly 78 to a lower portion and a mid-portion of a front support leg member 26 of the main support housing 18 of the printing press 14.

Other methods of attachment to the printing press 14 are shown by the use of the foot support assemblies 216, 252 and side wall connector bracket assemblies 236, 264 as shown in FIGS. 7 and 8. The main function of the anchor bracket assembly 42 is to provide a secure attachment to the printing press 14 and operable through the use of the adjustment assemblies 94 to adjust the vertical positioning of the main support jack assembly 40 relative to the adjacent side wall member 24 of the printing press 14. In this condition, the colorhead support assembly 44 is first attached to the connector shaft 67 of the main support jack assembly 40. This is accomplished through attachment of the mounting bar assembly 118 and, more specifically, the connector shaft 67 is inserted within the connector hole 130 of the tube member 124 and rests downwardly on the support collar member 64 for pivotal movement thereabout.

Next, the mounting bar assembly 118 is secured to an undersurface of the colorhead printing assembly 16 through a pair of spaced bolt members extended through the connector holes 178 in the mounting bar member 172.

The mounting bar assembly 118 includes a pair of support cone assemblies 185 which are mounted on each opposite side of the parallel side wall members 24 of the printing press 14 as noted in FIG. 2.

The mounting bar assembly 118 is secured to an undersurface of the colorhead printing assembly 16 by bolt members so that the conical support surfaces 181 in the mounting bar member 172 are placed directly in line with the respective ones of the support cone assemblies 188. More specifically, the conical support surfaces 181 are aligned with and engage respectively with the conical surfaces 203 of the cone members 194. During this period, slight adjustments can be made so that when the mounting bar assembly 118 with the colorhead printing assembly 16 mounted therein is placed over the respective ones of the support cone assemblies 188 and lowered thereon that the cooperating conical support surfaces 181, 203 operate to properly center the colorhead printing assembly 16 laterally and forwardly to achieve a proper alignment when in the print usage condition as noted in FIG. 1.

The conical support openings 180 of the mounting bar member 172 is a first self-centering means which cooperates with the support cone assemblies 188 being a second self-centering means to achieve the self-centering function of this invention.

As noted in FIGS. 4 and 5, the mounting support bar assembly 120 includes a colorhead latch assembly 126 mounted on one end thereof and a side plate member 128 adjustably mounted on an upper surface of the tube member 124 at an opposite end thereof to hold the colorhead printing assembly 16 therebetween. The colorhead latch assembly 126 includes an anchor screw 142 operable to be spring loaded and grasp a portion of the colorhead printing assembly 16 as noted in FIG. 5 to prevent lateral movement in one direction.

In the use and operation of the colorhead printer mounting apparatus 12, assume the position of FIG. 1 with the colorhead printer assembly 16 mounted on the colorhead printer mounting assembly 12. At this time, it is determined that the colorhead printing assembly 16 needs to be removed from the printing press 14 for repair and maintenance or change of a printing operation. The first step is to use a wrench and to loosen the set screw members 184 at each end of the mounting bar member 172 so as to release pressure on the respective ones of the support cone assemblies 188, more particularly, the cone members 194 which will then permit the colorhead printing assembly 16 to move upwardly from the printing press 14 as noted in FIG. 9 with the press connector assembly 46 in a released condition.

Next, the operator can rotate the actuator handle member 70 to move the inner telescoping tube member 50 vertically as noted by arrow 338 in FIG. 1. On clearing the conical support openings 180 of the mounting bar member 172 from the adjacent respective cone members 194, it is noted that the entire colorhead printing assembly 16 attached to the colorhead printer mounting apparatus 12 can be pivoted laterally about its connection to the connector shaft 37 on the main support jack assembly 40 in a direction indicated by arrow 342 in FIG. 2.

On removal to the outward pivoted position or non-use condition, it is obvious that repair and maintenance can be readily accomplished on the printing press 14 and the colorhead printing assembly 16 without requiring the movement to a workbench requiring two operators to do so.

It is noted that the paper feed assembly 30 of the printing press 14 may be removed to a lower position as noted in solid lines in FIG. 6 by release of the roller latch member 29. The latch member 29 may be needed to allow clearance for pivotal movement of the colorhead printing assembly 16 on the colorhead printer mounting apparatus 12 to the non-use condition of FIG. 2.

After the repair, maintenance, or use for another printing operation occurs, the interconnected colorhead printing assembly 16 on the colorhead printer mounting apparatus 12 can be pivoted opposite to arrow 342 in FIG. 1 toward the print usage condition of FIG. 1.

On reaching an inward position as noted in FIG. 1, the inner telescoping tube member 124 of the main support jack assembly 40 is lowered through use of the actuator handle member 70 in a direction opposite of arrow 338. This places the conical support surface 181 of the mounting bar member 172 onto and about the conical support surface 203 of the support cone assembly 188 of the mounting cone assembly 174 so that the complete weight of the mounting bar assembly 118 and the colorhead printing assembly 16 are resting thereon to achieve the self-centering means feature of this invention.

Next, the press connector bracket members 208 with the respective anchor bolt members 210 are operable to be retracted and released under spring pressure to engage within a respective hole 215 in the support wall members 36 of the colorhead printing assembly 16. Also, at this time, a wrench member is utilized with the set screw members 184 in the set screw openings 182 so as to tighten down on the respective cone members 194 to anchor in this print usage position.

The colorhead printer mounting apparatus 12 of this invention is readily attachable to an existing printing press 14 with a minimum amount of skill and tools and provides a mounting means to achieve reconnection of the colorhead printing assembly 16 in precise location as to which it was originally installed which is not possible when utilizing two operators to manually remove a colorhead printing assembly 16 from a colorhead printing press 14 as done in the prior art practices.

In the use and operation of another embodiment of the colorhead printer mounting apparatus 12 as shown in FIGS. 8 and 10, a colorhead trolley support assembly 272 is utilized with its main function being to move the colorhead printing assembly 16 being attached to a mounting bar assembly 118 when it is required that the colorhead printing assembly 16 be moved laterally in one direction and then vertically in order to clear parts of the printing press 14.

This embodiment uses the same mounting bar member 172 with the conical support surfaces 181 which are engagable with conical surfaces 203 of the main cone assemblies 188 of the mounting cone assembly 174 to achieve the same self-centering function as previously described.

In the operation of this embodiment using the colorhead trolley support assembly 272, the wrench member is utilized to release the set screw members 184 from engagement with the conical surfaces 203 of the cone members 194. The entire mounting bar assembly 118 and interconnected colorhead printing assembly 16 are slightly raised through the use of the main support jack assembly 40 as noted by arrow 338 in FIG. 1. On reaching a clearance of the mounting bar assembly 118 relative to a top surface of a cone member 194, the handle member 326 is grasped to move the colorhead trolley support assembly 172 outwardly as indicated by arrow 344 in FIG. 8. On subsequent outward movement to clear the various possible conflicting parts between the colorhead printing assembly 16 and the printing press 14, the actuator handle member 70 can be rotated to further elevate the inner telescoping tube member 50 and attached colorhead printing assembly 16 to a cleared position. Next, the inner telescoping tube member 50 and attached colorhead trolley support assembly 272 are pivoted outwardly as noted by arrow 342 in FIG. 2 to the non-usage condition.

The main function of the colorhead trolley support assembly 272 embodiment is to provide the additional feature of moving the mounting bar assembly 118 and attached colorhead printing assembly 16 laterally before vertical movement for clearance purposes. It is noted in FIG. 10 that, once the colorhead trolley support assembly 272 is moved outwardly according to arrow 344, the lock screw member 334 can be used to engage the main handle shaft 324 to lock in the retracted position for safety reasons.

It is noted that the colorhead printer mounting apparatus 12 of this invention is readily attachable to a colorhead printing assembly 16 on the printing press 14 without requiring the drilling of holes, special tools, or skill to install. The colorhead printer mounting apparatus 12 is connected to the colorhead printing assembly 16 and operable to move same with a minimum amount of time and effort by a single printing press operator from a fully engaged printing condition to a non-use condition for changing a printing operation or repair and maintenance thereon.

An important feature of this invention is the use of the mounting cone assembly 174 and conical support openings 180 so as to achieve proper lateral and vertical positioning of the colorhead printing assembly 16 relative to the printing press 14 which is extremely important in a two color press operation as the alignment has to be substantially perfect for quality production of printing materials.

In the retracted non-use condition of FIG. 2, it is seen that the colorhead printing assembly 16 can be removed from the lift arm assembly 116 for repair or replacement. Concurrently or separately, the lift arm assembly 116 can be easily removed from the main support jack assembly 40.

In the usage condition of FIG. 1, the lift arm assembly 116 is released from the colorhead printing assembly 16 and pivoted to the non-use condition. Then, the lift arm assembly 116 may be removed from the main support jack assembly 40 so as not to interfere in a printing operation of the printing press 14.

The colorhead printer mounting apparatus of this invention is sturdy in construction; easy to install; requires a minimum amount of maintenance; and reliable in removing and replacing a colorhead printing assembly to the exact position needed to achieve a quality printing operation.

While the invention has been described in conjunction with specific preferred specific embodiments thereof, it will be understood this description is intended to illustrate and not to limit the scope of the invention, which is defined by the following claims:

We claim:

1. A colorhead printer mounting apparatus connectable to a colorhead printing assembly used with a printing press, comprising:

(a) a main support jack assembly mounted adjacent to a printing press having a vertically movable support member;

(b) a colorhead support assembly pivotally mounted on said support member and releasably connected to a colorhead printing assembly;

(c) said colorhead support assembly includes a lift arm assembly engagable with said colorhead printing assembly to support same thereon;

(d) said lift arm assembly moved by said main support jack assembly to disconnect said colorhead printing assembly from said printing press and pivotal to move said colorhead printing assembly outwardly and laterally of said printing press to a non-usage condition for repair and maintenance operations.

2. A colorhead printer mounting apparatus as described in claim 1, wherein:

(a) said lift arm assembly includes a main support bar assembly having a colorhead support arm assembly connected thereto; and (b) said main support bar assembly includes a tube member pivotally connected at one end to said support member and having a latch assembly releasably connected to said colorhead printing assembly to hold against said tube member.

3. A colorhead printer mounting apparatus as described in claim 2, wherein:

(a) said main support bar assembly includes a side plate member mounted on said tube member and engages said colorhead printing assembly to hold against lateral movement in cooperation with said latch assembly.

4. A colorhead printer mounting apparatus as described in claim 1, wherein:

(a) said colorhead support assembly includes a mounting bar assembly having a mounting bar member connected to said colorhead printing assembly and a mounting assembly secured to said printing press; and (b) said mounting bar member engaged with said mounting assembly in a usage condition to hold said colorhead printing assembly in a precise position in said printing press for a printing operation.

5. A colorhead printer mounting apparatus as described in claim 4, wherein:

(a) said mounting bar includes first centering means engagable with second centering means on said mounting assembly when in the print usage condition to achieve accurate, repeat positioning of said colorhead printing assembly on said printing press.

6. A colorhead printer mounting apparatus as described in claim 5, wherein:

(a) said first centering means having a conical support opening; and (b) said second centering means having a cone member engagable with said conical support opening to achieve a self-centering of said mounting bar when interconnecting said colorhead printing assembly on said mounting assembly to prevent lateral and downward movement.

7. A colorhead printer mounting apparatus as described in claim 2, wherein:

(a) said support arm assembly includes a support frame assembly having anchor support lugs connected thereto; and (b) said anchor support lugs engagable with said mounting bar to prevent lateral and downward movement thereof when supporting same.

8. A colorhead printer mounting apparatus as described in claim 1, including:

(a) an anchor bracket assembly connects said main support jack assembly to said printing press; and (b) said anchor bracket assembly includes an adjustment assembly engagable with an adjacent support surface to adjustably position said main support jack assembly relative to said printing press.

9. A colorhead printer mounting apparatus connectable to a colorhead printing assembly and used with a printing press, comprising:

(a) a main support jack assembly mounted adjacent to a printing press having a vertically movable support member;

(b) a colorhead trolley support assembly pivotally mounted on said support member and releasably connected to a colorhead printing assembly;

(c) said colorhead trolley support assembly includes a lift arm assembly having a trolley support arm assembly mounted on said lift arm assembly and engagable with said colorhead printing assembly to support same thereon; and (d) said lift arm assembly moved by said main support jack assembly to disconnect said colorhead printing assembly from said printing press;

(e) said trolley support arm assembly and interconnected said colorhead printing assembly moved laterally on said lift arm assembly from said printing press; and (f) said colorhead trolley support assembly pivotal about said support member to move outwardly and laterally of said printing press to a non-usage position for repair and maintenance operations.

10. A colorhead printer mounting apparatus as described in claim 9, wherein:

(a) said trolley support arm assembly moved laterally on said lift arm assembly move said colorhead printer assembly laterally in one outward direction relative to said printing press.

11. A colorhead printer mounting apparatus as described in claim 10, wherein:

(a) said main support jack assembly moved vertically to disconnect said colorhead printing assembly from said printing press; and (b) said support member pivotal to move said colorhead printing assembly to the non-usage position for repair and maintenance operations.

12. A colorhead printer mounting apparatus as described in claim 9, wherein:

(a) said lift arm assembly includes a main support bar assembly having a colorhead support arm assembly connected thereto; and (b) said main support bar assembly includes a tube member pivotally connected at one end to said support member and having a latch assembly releasably connected to said colorhead printing assembly to hold against said tube member.

13. A colorhead printer mounting apparatus as described in claim 9, wherein:

(a) said colorhead trolley support assembly includes a mounting bar assembly having a mounting bar member connected to said colorhead printing assembly and a support cone assembly secured to said printing press; and (b) said mounting bar member engaged with said support cone assembly in a usage condition to hold said colorhead printing assembly in a precise position in said printing press for a printing operation.

14. A colorhead printer mounting apparatus as described in claim 13, wherein:

(a) said mounting bar includes first centering means engagable with second centering means on said support cone assembly when in the print usage condition to achieve accurate, repeat positioning of said colorhead printing assembly on said printing press.

15. A colorhead printer mounting apparatus as described in claim 14, wherein:

(a) said first centering means having a conical support opening; and (b) said second centering means having a cone member engagable with said conical support opening to achieve a self-centering of said mounting bar connected to said colorhead printing assembly on said support cone assembly to prevent lateral and downward movement.

16. A colorhead printer mounting apparatus connectable to a colorhead printing assembly and used with a printing press, comprising:

(a) a main support assembly mounted adjacent to a printing press having a vertically movable support member;

(b) a colorhead support assembly mounted on said support member and releasably connected to a colorhead printing assembly;

(c) said colorhead support assembly includes a mounting bar assembly having a mounting bar member connected to said colorhead printing assembly and a mounting assembly connected to said printing press; and (d) said mounting bar member having a first self-centering means engagable with a second self-centering means on said mounting assembly.

17. A colorhead printer mounting apparatus as described in claim 16, wherein:

(a) said second self-centering means having cone members engagable with said first self-centering means on said mounting bar member to precisely mount said colorhead printing assembly on said printing press for a printing operation.

18. A colorhead printer mounting apparatus as described in claim 16, wherein:

(a) said colorhead support assembly pivotally and releasably mounted on said support member;

whereby said colorhead support assembly can be pivoted outwardly from said printing press so as to use said printing press for a printing operation without said colorhead printing assembly and said colorhead support assembly can be removed from said support member and moved to a storage condition.

* * * * *

US004934264B1

REEXAMINATION CERTIFICATE (2192nd)

United States Patent [19]

[11] B1 4,934,264

Gansky et al.

[45] Certificate Issued Jan. 18, 1994

[54] COLORHEAD PRINTER MOUNTING APPARATUS

[76] Inventors: Alton E. Gansky, 4623 Bella Dr.; William A. Harris, 4490 Emerald Dr., both of, Colorado Springs, Colo. 80918

Reexamination Request:
No. 90/002,789, Jul. 20, 1992

Reexamination Certificate for:

| | |
|---|---|
| Patent No.: | 4,934,264 |
| Issued: | Jul. 6, 1989 |
| Appl. No.: | 376,241 |
| Filed: | Jun. 19, 1990 |

[51] Int. Cl.[5] ..... B41F 5/02; B41F 13/44

[52] U.S. Cl. ..... 101/175; 101/177; 101/247; 101/DIG. 35

[58] Field of Search ..... 101/174-175, 101/177, 184-185, 136-140, 143-144, 216-219, 247-248, 349-351, DIG. 35

[56] References Cited

U.S. PATENT DOCUMENTS

| | | | |
|---|---|---|---|
| 1,164,212 | 12/1915 | Reifsnyder et al. | 101/216 |
| 2,896,536 | 7/1959 | Sauerman | 101/175 |
| 3,738,265 | 6/1973 | Saueressig | 101/3561 |
| 4,111,120 | 9/1978 | Paulson | 101/175 |
| 4,756,245 | 7/1988 | Roch | 101/247 |
| 4,876,958 | 10/1989 | Townsend | 101/175 |
| 4,967,658 | 11/1990 | Townsend | 101/175 |

*Primary Examiner*—Eugene H. Eickholt

[57] ABSTRACT

This invention relates to a colorhead printer mounting apparatus operable to be secured to a printing press and connectable to a colorhead printing assembly usable with the printing press. The colorhead printer mounting apparatus includes a main support jack assembly secured by an anchor bracket assembly to the printing press and having a colorhead support assembly mounted thereon which is operable to support the colorhead printing assembly thereon. The colorhead support assembly includes a mounting bar assembly secured to the colorhead printing assembly and having self-centering means for releasable connection to the colorhead printing assembly operable for raising, lowering, and pivotally moving to a non-use position for repair and maintenance thereon. A second embodiment of this invention utilizes a colorhead trolley support assembly having a mounting bar assembly connected to the colorhead printing assembly and a trolley support arm assembly operable through a trolley actuator assembly in order to move the mounting bar assembly and the interconnected colorhead printing assembly laterally before moving vertically in order to clear various obstacles between the colorhead printing assembly and the printing press. Numerous lock feature structures are provided for holding the colorhead printing assembly in a secure condition when in the usage condition and for securing the colorhead printing assembly to the lift arm assembly of the colorhead support assembly to prevent unintentional damage or dropping of the colorhead printing assembly when moving to the non-usage condition.

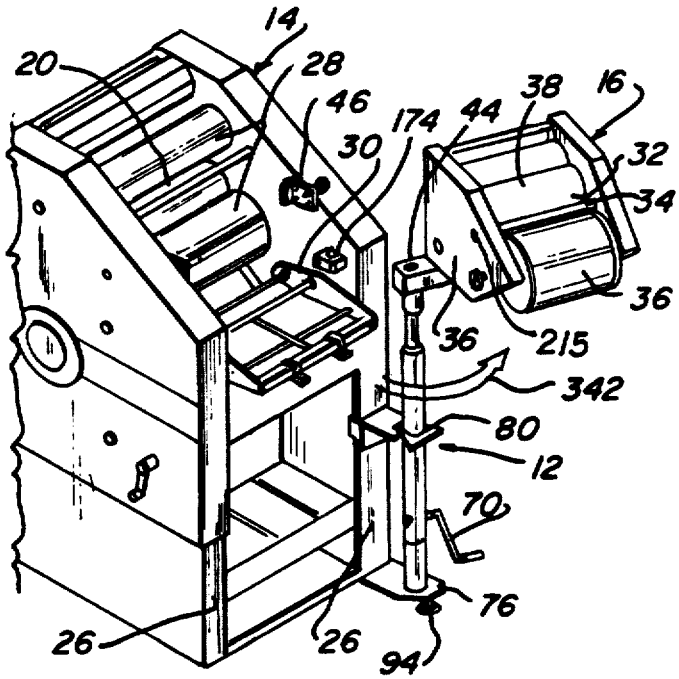

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9–18 is confirmed.

Claims 2–3, 5 and 8 are cancelled.

Claims 1, 4, 6 and 7 are determined to be patentable as amended.

New claims 19–22 are added and determined to be patentable.

1. A colorhead printer mounting apparatus connectable to a colorhead printing assembly used with a printing press, comprising:

(a) a main support jack assembly mounted adjacent to a printing press having a vertically movable support member;

(b) a colorhead support assembly pivotally mounted on said support member and releasably connected to [a] *said* colorhead printing assembly;

(c) said colorhead support assembly includes a lift arm assembly engagable with said colorhead printing assembly to support same thereon;

(d) said lift arm assembly moved by said main support jack assembly to disconnect said colorhead printing assembly from said printing press and pivotal to move said colorhead printing assembly outwardly and laterally of said printing press to a non-usage condition for repair and maintenance operations[.] ;

*(e) said lift arm assembly includes a main support bar assembly having a colorhead support arm assembly connected thereto;*

*(f) said main support bar assembly includes a tube member pivotally connected at one end to said support member and having a latch assembly mounted on said tube member and releasably connected to said colorhead printing assembly to hold against said tube member; and*

*(g) said main support bar assembly includes a side plate member mounted on said tube member and engages said colorhead printing assembly to hold against lateral movement in cooperation with said latch assembly.*

4. [A colorhead printer mounting apparatus as described in claim 1, wherein:] *A colorhead printer mounting apparatus connectable to a colorhead printing assembly used with a printing press, comprising:*

*(a) a main support jack assembly mounted adjacent to a printing press having a vertically movable support member;*

*(b) a colorhead support assembly pivotally mounted on said support member and releasably connected to said colorhead printing assembly;*

*(c) said colorhead support assembly includes a lift arm assembly engagable with said colorhead printing assembly to support same thereon;*

*(d) said lift arm assembly moved by said main support jack assembly to disconnect said colorhead printing assembly from said printing press and pivotal to move said colorhead printing assembly outwardly and laterally of said printing press to a non-usage condition for repair and maintenance operations;*

[(a)] *(e)* said colorhead support assembly includes a mounting bar assembly having a mounting bar member connected to said colorhead printing assembly and a mounting assembly secured to said printing press; [and ]

[(b)] *(f)* said mounting bar member engaged with said mounting assembly in a usage condition to hold said colorhead printing assembly in a precise position in said printing press for a printing operation[.]*; and*

*(g) said mounting bar member includes first self-centering means engagable with second self-centering means on said mounting assembly when in the print usage condition to achieve accurate, repeat positioning of said colorhead printing assembly on said printing press.*

6. A colorhead printer mounting apparatus as described in claim [5] *4*, wherein:

a) said first [centering]*self-centering* means having a conical support opening; and b) said second [centering] *self-centering* means having a cone member engagable with said conical support opening to achieve a self-centering of said mounting bar *member* when interconnecting said colorhead printing assembly on said mounting assembly to prevent lateral and downward movement.

7. [A colorhead printer mounting apparatus as described in claim 2, whrein:] *A colorhead printer mounting apparatus connectable to a colorhead printing assembly used with a printing press, comprising:*

*(a) a main support jack assembly mounted adjacent to a printing press having a vertically movable support member;*

*(b) a colorhead support assembly pivotally mounted on said support member and releasably connected to said colorhead printing assembly;*

*(c) said colorhead support assembly includes a lift arm assembly engagable with said colorhead printing assembly to support same thereon;*

*(d) said lift arm assembly moved by said main support jack assembly to disconnect said colorhead printing assembly from said printing press and pivotal to move said colorhead printing assembly outwardly and laterally of said printing press to a non-usage condition for repair and maintenance operations;*

*(e) said lift arm assembly includes a main support bar assembly having a colorhead support arm assembly connected thereto;*

*(f) said main support bar assembly includes a tube member pivotally connected at one end to said support member and having a latch assembly mounted on said tube member and releasably connected to said colorhead printing assembly to hold against said tube member;*

[(a)] (g) said support arm assembly includes a support frame assembly having *a support bar with* anchor support lugs connected thereto; [and]

*(h) said colorhead support assembly includes a mounting bar assembly having a mounting bar member connected to said colorhead printing assembly and a mounting assembly secured to said printing press;*

*(i) said anchor support lugs each include an L-shaped body section having an upright connector section cooperating with an upright surface of said support bar to receive and engage said mounting bar member; and*

[(b)] *(j)* said anchor support lugs *and said upright surface* engagable with said mounting bar *member* to prevent lateral and downward movement thereof when supporting same.

*19. A colorhead printer mounting apparatus connectable to a colorhead printing assembly used with a printing press, comprising:*

*(a) a main support jack assembly mounted adjacent to a printing press having a vertically movable support member;*

*(b) a colorhead support assembly pivotally mounted on said support member and releasably connected to said colorhead printing assembly;*

*(c) said colorhead support assembly includes a lift arm assembly engagable with said colorhead printing assembly to support same thereon;*

*(d) said lift arm assembly moved by said main support jack assembly to disconnect said colorhead printing assembly from said printing press and pivotal to move said colorhead printing assembly outwardly and laterally of said printing press to a non-usage condition for repair and maintenance operations;*

*(e) said colorhead support assembly includes a mounting bar assembly having a mounting bar member connected to said colorhead printing assembly and a mounting assembly secured to said printing press; and*

*(f) said mounting bar member includes first self-centering means engagable with second self-centering means on said mounting assembly when in the print usage condition to achieve accurate, repeat positioning of said colorhead printing assembly on said printing press.*

*20. A colorhead printer mounting apparatus connectable to a colorhead printing assembly used with a printing press, comprising:*

*(a) a main support jack assembly mounted adjacent to a printing press having a vertically movable support member;*

*(b) a colorhead support assembly pivotally mounted on said support member and releasably connected to said colorhead printing assembly;*

*(c) said colorhead support assembly includes a lift arm assembly engagable with said colorhead printing assembly to support same thereon;*

*(d) said lift arm assembly moved by said main support jack assembly from said printing press and pivotal to move said colorhead printing assembly outwardly and laterally of said printing press to a non-usage condition for repair and maintenance operations;*

*(e) said lift arm assembly includes a main support for assembly having colorhead support arm assembly connected thereto;*

*(f) said support arm assembly includes a support frame assembly having a support bar with anchor support lugs connected thereto;*

*(g) said colorhead support assembly includes a mounting bar assembly having a mounting bar member connected to said colorhead printing assembly and a mounting assembly secured to said printing press;*

*(h) said anchor support lugs each include an L-shaped body section cooperating with an upright connector section cooperating with an upright surface of said support bar to receive and engage said mounting bar member; and*

*(i) said anchor support lugs and said upright surface engagable with said mounting bar member to prevent lateral and downward movement thereof when supporting same.*

*21. A colorhead printer mounting apparatus connectable to a colorhead printig assembly used with a printing press, comprising:*

*(a) a main support jack assembly mounted adjacent to a printing press having a vertically movable support member;*

*(b) a colorhead support assembly pivotally mounted on said support member and releasably connected to said colorhead printing assembly;*

*(c) said colorhead support assembly includes a lift arm assembly engagable with said colorhead printing assembly to support same thereon;*

*(d) said lift arm assembly moved by said main support jack assembly to disconnect said colorhead printing assembly from said printing press and pivotal to move said colorhead printing assembly outwardly and laterally of said printing press to a non-usage condition for repair and maintenance operations;*

*(e) said colorhead support assembly includes a mounting bar assembly having a mounting bar member connected to said colorhead printing assembly and a support cone assembly secured to said printing press; and*

*(f) said mounting bar member engaged with said support cone assembly in a usage condition to hold said colorhead printing assembly in a precise position in said printing press for a printing operation.*

*22. A colorhead printer mounting apparatus as described in claim 21, wherein:*

*(a) said mounting bar includes first centering means engagable with second centering means on said support cone assembly when in the print usage condition to achieve accurate, repeat positioning of said colorhead printing assembly on said printing press.*

* * * * *